United States Patent [19]

Ive

[11] Patent Number: 4,638,272

[45] Date of Patent: Jan. 20, 1987

[54] LOSSY TRANSMISSION LINE USING SPACED FERRITE BEADS

[75] Inventor: Richard A. Ive, Eaton Town, N.J.

[73] Assignee: The Commonwealth of Australia, Canberra, Australia

[21] Appl. No.: 692,885

[22] PCT Filed: May 4, 1984

[86] PCT No.: PCT/AU84/00076

§ 371 Date: Jan. 2, 1085

§ 102(e) Date: Jan. 2, 1985

[87] PCT Pub. No.: WO84/04426

PCT Pub. Date: Nov. 8, 1984

[30] Foreign Application Priority Data

May 5, 1983 [AU] Australia ..... PF 9191/83

[51] Int. Cl.[4] ..... H01P 3/04

[52] U.S. Cl. ..... 333/236; 178/45; 333/22 R

[58] Field of Search ..... 333/22 R, 23, 81 R, 333/81 A, 236, 243–245; 174/36; 178/45, 46

[56] References Cited

U.S. PATENT DOCUMENTS

| | | | |
|---|---|---|---|
| 1,900,962 | 3/1933 | Vezey | 178/45 |
| 2,228,797 | 1/1941 | Wassermann | 178/45 |
| 2,748,386 | 5/1956 | Polydoroff . | |
| 3,560,889 | 2/1971 | Suetake et al. | 333/22 R |
| 4,104,600 | 8/1978 | Mayer . | |
| 4,233,577 | 11/1980 | Raveglia et al. . | |

FOREIGN PATENT DOCUMENTS

| | | |
|---|---|---|
| 0040567 | 11/1981 | European Pat. Off. . |
| 0087371 | 8/1983 | European Pat. Off. |
| 2140255 | 1/1973 | France. |
| 58-69101 | 4/1983 | Japan . |
| 628928 | 9/1949 | United Kingdom . |

*Primary Examiner*—Paul Gensler

*Attorney, Agent, or Firm*—Roylance, Abrams, Berdo & Goodman

[57] ABSTRACT

A lossy transmission line in which the effective length of the line is reduced by providing resistive ferrite beads spaced along the line to provide constant power loss per unit length. Inductance ferrite beads may be included equally spaced along the line. Resistive beads are located with increasing frequency per unit length from the beginning of the line until a maximum bead density per unit length is achieved. The lossy line is suitable as a terminating unit for a portable travelling wave antenna and in other situations where size reduction is desirable.

8 Claims, 4 Drawing Figures

FIG. 1
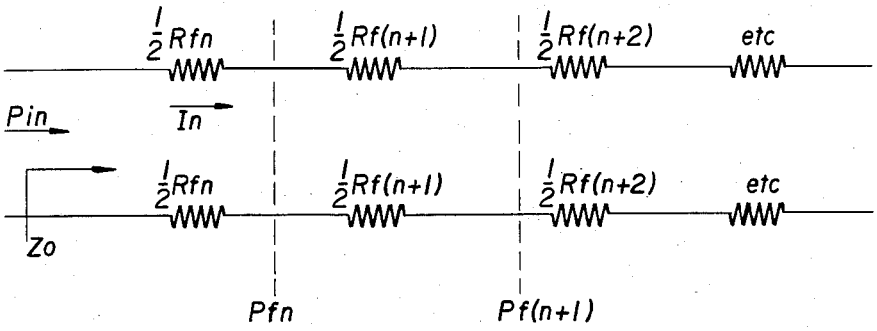
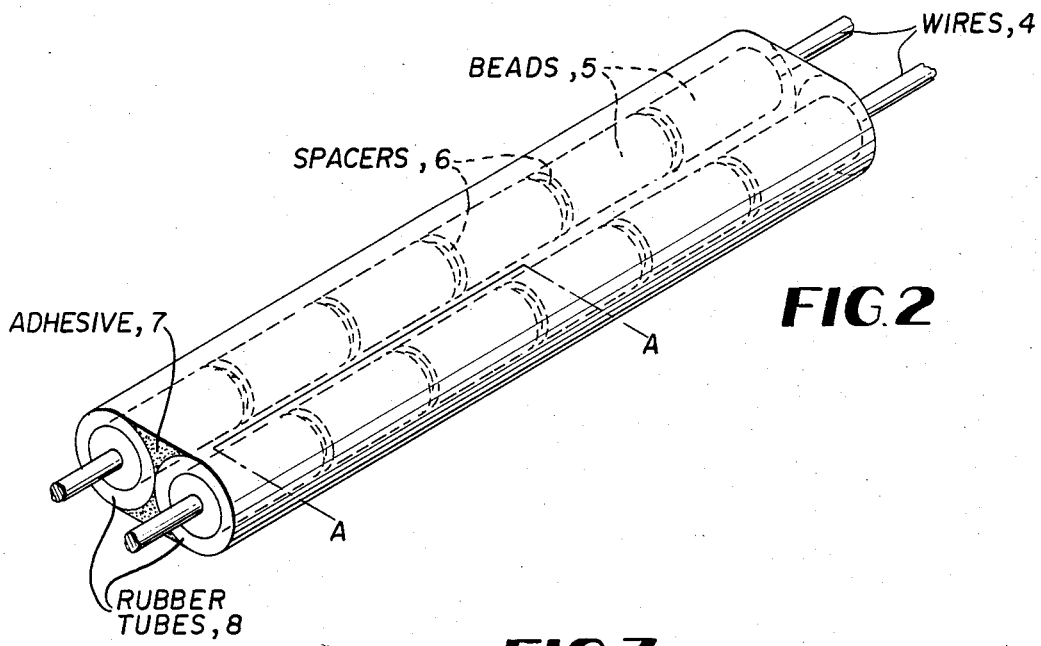
FIG. 2
FIG. 3
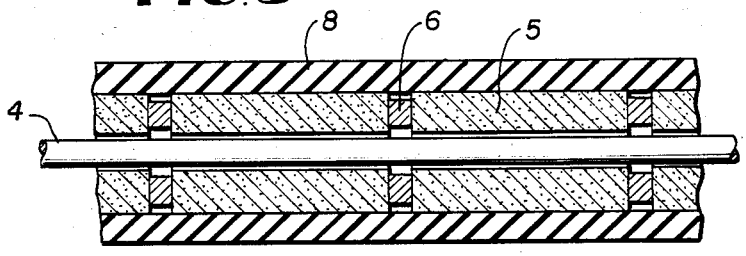
FIG. 4
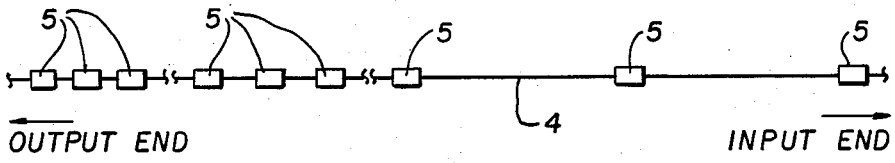

LOSSY TRANSMISSION LINE USING SPACED FERRITE BEADS

This invention relates to transmission lines particularly lossy transmission lines, which are defined as cables or lines having high attenuation per unit length.

The characteristic impedance (Zo) of a transmission line is normally characterized in terms of the distributed series resistance (R) and inductance (L) elements, and the distributed shunt conductance (G) and capacitance (C) elements, by the following expression:

$$Zo = \sqrt{\frac{R + jwL}{G + jwC}} \text{ Ohms}$$

The attenuation constant ($\alpha$) is given by the expression $$\alpha = (R/2Zo) + (GZo/2) \text{Neper/m}$$

For open wire lines G approaches zero, and for low loss lines R<<wL, hence $$Zo = \sqrt{\frac{L}{C}}$$

For conventional lossy lines where the series resistance is the significant loss element, $$Zo = \sqrt{\frac{L}{C}} \sqrt{1 - j\frac{R}{wL}}$$

which can be rearranged into the form $$Zo = \sqrt{\frac{L}{C}} (a - jb)$$

and $$\alpha = R/2Zo$$

The capacitive reactance (−b) component of Zo will cause a mismatch between the lossy line and the normally purely resistive source.

The resulting mismatch, which is commonly specified in terms of the voltage standing wave ratio (VSWR), will typically govern the acceptability of the match and hence the ratio of R/wL has an upper limit determined by the highest acceptable VSWR.

Hence, for a given frequency range the value of resistance per unit length (R) has an upper limit which in turn determines the upper limit of attenuation ($\alpha$).

In conventional lossy lines used as terminating units it is very desirable that they provide a minimum of 20 dB attenuation. Under this condition the termination at the far end of the line is of little or no importance in terms of matching at the input end of the line.

The minimum line length required to achieve 20 dB attenuation ($\alpha$) for a specified line impedance (Zo), "match" (VSWR), and frequency range can therefore be determined.

The power capability of such a line is a function of the wire diameter and/or allowable temperature rise at the input end of the line.

By way of example, a typical conventional 600 Ω lossy transmission line exhibiting a VSWR of <1.5 and capable of dissipating 1 kW over the HF frequency range would need to be approximately 140 meters long to satisfy the VSWR requirement, but would need to be approximately 600 meters long to satisfy the power rating. (Assumes a maximum temperature rise of approximately 200° C.-higher temperatures would require the use of impractically small wire diameters.)

Thus a disadvantage with conventional lossy lines is the long length required. This makes them unsuitable as terminating units for applications such as portable travelling wave antenna and may even make them unsuitable for fixed travelling wave antenna where space is at a premium.

Typically, terminating units for portable (and some fixed) travelling wave antenna consist of a "lumped" resistive element which may be required at the top of the antenna mast.

This is a distinct disadvantage, especially for high power transmitting antenna because of the significant wind loading on the terminating unit. This necessitates a more rugged mast and guy arrangement which consequently increases the weight and volume of the antenna and makes is less portable.

This invention describes an improved lossy transmission line which overcomes the disadvantages of:

a. long conventional lossy transmission lines, and b. large physical size and weight of lumped resistive elements.

It is an object of this invention to provide a short well matched lossy transmission line to replace long conventional lossy transmission lines or lumped resistive element terminating units.

To this end this invention provides a lossy line which exhibits approximately constant loss per unit length (watts/m) characterized in that a conventional low loss transmission line is modified by securing ferrite beads to the wire.

Ferrite beads have previously been proposed for use as absorbers of electromagnetic energy as detailed in German Pat. No. 2,524,300.

Ferrite beads have also previously been proposed for use as a means of artificially loading antenna elements to reduce their physical length as detailed in U.S. Pat. Nos. 2,748,386 and 3,303,208. However the fundamental and unique difference between the use of ferrite material as disclosed in these patent specifications, and the lossy transmission line of this invention is that the latter exploits the Curie effect phenomena to achieve a self regulating line resistance resulting in high power loss per unit length which is essentially maintained until all the input power is absorbed. Taking advantage of the Curie effect is the key to the successful design and operation of a lossy transmission line of minimum length which maintains a good input match (VSWR) over a wide power frequency spectrum.

The use of the ferrite material as disclosed in the above mentioned German patent to simply absorb power and not operate at the Curie temperature is not very different from using a higher resistance wire for the transmission line, with the resulting constant (and low) attenuation and long line length.

The modified lossy line of this invention results in an order of magnitude reduction in the line length required to achieve the same power capability and quality of match as a conventional lossy line, and at the same time is capable of dissipating high powers without generating excessively high temperature.

The lossy line of this invention achieves this by exhibiting approximately "constant power loss" per unit length (watts/m) compared with "constant attenuation" per unit length (dB/m) for a conventional lossy line.

When cold, the ferrite beads offer a significant resistance to radio frequency current which causes rapid heating until stabilization is achieved at nominally Curie tempeature. At this point the heat generated is equal to the heat dissipated and the individual "hot" ferrite bead impedance may be several orders of magnitude less than the "cold" impedance.

Under these conditions the effective resistance per unit length (R)—which automatically adjusts itself along the line to maintain constant temperature, —is nominally equal to the design value allowed by the required quality of match. Thus the line operates at constant temperature along a sufficient portion of its length to absorb nominally all of the input power.

This results in a high and approximately constant power loss per unit length along the line until nominally all the power is absorbed, at which point the apparent open circuit seen looking further down the line is of no consequence.

In conventional transmission lines the attenuation remains constant along the line and hence the power dissipated per unit length of line falls away very rapidly which results in a very long line.

FIG. 1 is an electrical schematic representation of a section of a lossy transmission line in accordance with the invention;

FIG. 2 shows a segment of a lossy transmission line according to a preferred embodiment of the invention;

FIG. 3 is a cross-sectional view taken along line A—A of FIG. 2; and

FIG. 4 is a schematic illustration of the variable spacing of the beads in accordance with the invention.

It would be very attractive to be able to maintain constant power dissipation along the line as distinct from constant attenuation. In theory this can be achieved by increasing the resistance per unit length R along the line according to the following relationship:

$$R_{(l)}=P/[I_{(l)}]^2 \quad (1)$$

Where

P=power dissipated/unit length (constant)

$I_{(l)}$=current at distance l along line $R_{(l)}$=line resistance/unit length at distance l along line To assist in the analysis of a transmission line exhibiting constant loss/unit length consider a section of line as depicted in FIG. 1. The line can be considered as being made up of N elements whose individual resistances are such that the power dissipated per element Pn is constant and equal to the input power Pin divided by N; i.e.

$$Pn=Pin/N=Pfn-Pf(n+1) \quad (2)$$

$$Pfn-Pf(n+1)=(In)^2Rfn \quad (3)$$

$$Pfn=(In)^2Zo \quad (4)$$

From which it can be shown that:

$$Rfn=Zo/(N-n) \quad (5)$$

This expression can now be integrated over any number of elements to determine the cumulative resistance as follows:

$$\sum_{n}^{1} Rfn = Zo \log_e (N-n) \quad -(6)$$

It is useful to determine the value of $$\sum_{n}^{1} Rfn$$

for the following values of n:

n=N/4, N/2, 3N/4, N and they are:

$$\sum_{\frac{N}{4}}^{1} Rfn = Zo \log_e\left(\frac{4}{3}\right) = .2852\ Zo \quad -(7)$$

$$\sum_{\frac{N}{2}}^{1} Rfn = Zo \log_e 2 = .693\ Zo \quad -(8)$$

$$\sum_{\frac{3N}{4}}^{1} Rfn = Zo \log_e 4 = 1.386\ Zo \quad -(9)$$

$$\sum_{N}^{1} Rfn = Zo \log_e N \quad -(10)$$

The above expressions indicate two important points as follows:

a. The total line resistance required to achieve a desired attenuation is independent of input power and equals Zo $\log_2 2$ for 3 dB attenuation. This is a useful parameter for determining the actual line length required to dissipite a given power when the allowable R is known, or deducible from an allowable input VSWR.

b. The total line resistance required to dissapite all the power is directly proportional to the natural log of the number of elements which in turn equates to input power i.e. Zo log N.

This suggests that the number of elements per unit length should increase according to the natural logarithm and so give a constant average resistance per unit length regardless of input power.

It can be seen from the expression (5) above that the resistance of any particular element must decrease with increasing input power, ie as P increases, N increases, hence Rfn decreases.

Conversely, as the input power drops to very low levels the resistance of elements at the input end of the line must rise to very high values if the goal of constant loss is to be achieved over the full power spectrum. However, the requirement to maintain an acceptable match at the input places a restraint on the upper value of R/wL which in turn limits the value of R.

Summarizing, our ideal "model" which dissipates constant loss per unit length, comprises of N series elements whose individual resistance Rfn=Zo/(N−n) where N is directly proportional to input power. It suffers from the problem of requiring a minimum input power to maintain an acceptable match.

The restraint on the upper value of R/wL for our ideal model which is most significant at the lower power levels (and frequencies) can be accommodated by modifying the model so that the quantity of elements per unit length at the input end of the line is reduced. This will enable a satisfactory match to be maintained even at very low power levels at the cost of making the total line length a little longer.

It is this approach which has been adopted because it results in a lossy transmission line made up of N identical elements, only the spacing of which is varied.

Summarizing, our "modified ideal" model consists of N identical elements spaced in a non linear manner ie thinly spaced at input end and then asymptotes towards that of the "ideal" model as we move down the line. This modified model maintains an acceptable input match over a wide input power.

The "modified ideal" model can be realized with certain limitations by the use of ferrite beads as the elements and exploiting the fact that they exhibit a Curie point. Certain ferrite beads (cold) offer significant series resistance to RF current and consequently the beads generate sufficient heat to raise their temperature to the Curie temp at which point their resistance may fall several orders of magnitude. This fully reversible process provides the self regulating mechanism needed to ensure constant loss per element under a very wide range of input power levels and frequencies.

In order to achieve an acceptable input VSWR over a wide power range the quantity of elements (ferrites) per unit length increases exponentially. This is somewhat empirical but is reinforced by the expression (10) above derived for total line resistance.

The power rating of the constant loss line is, as the name suggests, directly proportional to the line length.

It is useful to plot a graph of ΣRf vs log n which is then equivalent to R vs l. By considering various values of N ie elements (or input power) and plotting values of Rf for n=N/4, N/2, 3N/4, and N, a family of curves can be drawn showing the variation of R along the line.

The allowable or design value of R can be deduced from knowing the input VSWR and the following expressions:

$$VSWR = \frac{1 + |K|}{1 + |K|} \text{ where} \quad -(11)$$

$$K = \frac{Z - Zo}{Z + Zo} \quad -(12)$$

$$Z = \sqrt{\frac{L}{C}}\ 4\sqrt{(1 + x^2)}\ /\ \frac{\arctan x}{2} \quad -(13)$$

where x=R/(WL)

Which is a rearrangement of $$Z = \sqrt{\frac{R + jwL}{G + jwc}} \quad -(14)$$

for the case where $$G=0. \quad (15)$$

(15)

The value of R can be drawn on the same graph as ΣRf vs log n and becomes a straight line passing through the origin and intercept of $$\frac{\sum_{\frac{N}{2}}^{1} Rf}{}$$

and the total cold ferrite resistance $$\frac{\sum_{\frac{N}{2}}^{1} Rfc.}{}$$

This ensures that the value of R is never exceeded prior to the 3 dB loss point (N/2) regardless of input power level, even when no beads are operating at Curie temperature, hence an acceptable input VSWR is maintained at all power levels. The line length required is simply scaled off the graph as the horizontal axis in addition to representing log n also represents l, at least up to the point where bead crowding begins ie where n per unit length exceeds that which can be physically fitted per unit length of line.

As already mentioned the value of R/wL is the factor limiting the resistance per unit length R and hence power loss per unit length. The inherent value of wL can be relatively low especially at low HF frequencies and hence the maximum allowable R is also low. Significant increases in wl (and hence R) can be achieved by artificially loading of the transmission line. The resulting reduction in line length is directly proportional to the degree of loading. In practice loading factors of 5 to 10 have easily been achieved.

To achieve even higher power dissipation rates, the transmission line can be "loaded" with additional inductance "L" in the form of a second type of ferrite bead and additional capacitance "C" created by the high dielectric constant of the ferrite material already present on the wires to provide the "R" and "L" elements. Optimizing the capacitive effects of ferrites leads to a reduced conductor spacing and consequently an improvement in the mechanical characteristics and a reduction in the volume.

The increase in possible power dissipation rate (watts/m) of the loaded constant loss line is directly proportional to the degree of "loading" assuming the same quality of match is required.

A constant loss line of a preferred embodiment of this invention is illustrated in FIGS. 2 and 3, FIG. 2 being a perspective view and FIG. 3 a section A—A of FIG. 2. The line comprises parallel stainless steel wires 4 which carry ferrite beads 5 spaced apart along the wires 4 by spacers 6. The beads 5, spacers 6 and wires 4 are enclosed in hermetically sealed silicon rubber tubes 8 which are bonded together by silicon rubber adhesive 7. This lossy line has the following pertinent parameters.

| | |
|---|---|
| Z = 600Ω | Line length 18 m |
| f = 2 → 30 MHz | Cross section 8 mm × 16 mm |
| P = 0 → 1 kW | Weight 4 kg |
| VSWR < 1.5 | Max operating temp 200° C. |
| | Hermetically sealed. |

A conventional lossy line providing the same capability would be approximately 650 m long. The line is loaded with 90 low loss inductive ferrite beads per meter to give a total inductance of approximately 12 $\mu$H/m and a corresponding capacitive loading to give a characteristic impedance of 600 Ω. The distribution of ferrite beads along the line increases exponentially according to the expression $N=e^{KL}$ (K is constant and L=length of line) until the size of the beads precludes further addition. Thus initially one "R" bead is provided every meter for the first three meters and then the number per meter is increased until all available space for the beads in each meter of wire is taken up. Each ferrite bead whether it is an R or L bead is separated by a silicon rubber spacer. Longer spacers are used where the presence of R beads is less frequent.

The lossy elements comprise of highly resistive low reactance ferrite beads whose distribution is given by the expression $N_R=e^{0.512l}$ until crowding occurs at $N_R=90$, at which point the resistive bead density remains constant at 90 beads per meter.

This distribution of resistive beads ensures that the VSWR does not exceed 1.5 which is equivalent to $R/wL \approx 0.8$ when $G=0$.

The beads are threaded onto 18 SWG stainless steel wire with a silicon rubber spacer between each bead to provide mechanical protection of beads and allow bending. Each threaded wire is placed in a silicon rubber tube and the two tubes are then joined together with silicon rubber adhesive. The tubes provide mechanical protection for the ferrite beads and in conjunction with the ferrite aid in producing the correct shunt capacitance.

This spacing of the beads on the wires 4 is shown schematically in FIG. 4. This schematic representation of FIG. 4 shows the distribution of the resistive beads only. The inductance beads are evenly distributed along the wire 4, and thus only the distribution of the resistive beads are schematically illustrated in FIG. 4. The dummy beads or spacers are omitted in FIG. 4.

As both the inductive and resistive beads contribute to the shunt capacitance it is essential that "dummies" be used at the input end where the distribution of resistive beads is low so as to maintain the required shunt capacitance but at the same time not offering any additional resistance or inductance. These can take the form of silicon rubber tubing of appropriate size.

The constant loss line of this invention has applicability as a terminating unit for a portable travelling wave antenna, and in many other situations where the long length of a conventional lossy line or the physical size and weight of a lumped resistive element is unacceptable.

It is clear that the length of a lossy transmission line can be dramatically reduced by the careful choice and distribution of ferrite material along a conventional transmission line while at the same time maintaining an acceptable input VSWR over a broad power frequency spectrum. The key to achieving this is the exploitation, of the Curie effect exhibited by the ferrite material which enables the line to automatically regulate its resistance per unit length to maintain a high power dissipation along the line until nominally all the power has been dissipated. Further reductions in line length can be achieved by artificially loading the transmission line.

Compared with a lumped resistive element terminating unit, the constant loss line of this invention is less than half the weight, less than one tenth the volume, results in less than one fifth the wind loading on the antenna mast, and the unit cost is expected to be considerably less.

Compared with a conventional lossy line, the constant loss line can be less than three percent of the length for the same quality of match and power rating (assumes the same maximum operating temperature).

The constant loss line is also likely to have wider application such as for broad band dummy loads. For example, an unbalanced version (coaxial) could be wound into a close helix and fitted with appropriate connectors at both ends. This would enable cascading of several dummy loads to provide a greater power rating when required. Dummy loads based on the constant loss line would have inherent overload protection, as any excess power would simply be passed through the device (if terminated) or reflected back (if unterminated).

From the above it can be seen that the present invention achieves its prime object of reducing the length of lossy lines and enables them to be of advantageous use as terminating units particularly for portable travelling wave antennas.

While the invention has been described in detail above, it is to be understood that this detailed description is by way of example only, and the protection granted is to limited only within the spirit of the invention and the scope of the following claims.

The claims defining the invention are as follows.

I claim:

1. A lossy transmission line comprising a conducting wire threaded with resistive ferrite beads which exhibits substantially constant power loss per unit length, and wherein the resistive ferrite beads are distributed sparsely at the beginning of the wire with frequency of distribution increasing to a maximum per unit length which is related to the size of the beads and the available space per unit length of the wire.

2. a lossy transmission line as claimed in claim 1 which includes both resistive and inductance ferrite beads along its length separated from each other by non conductive spacers.

3. A lossy transmission line as claimed in claim 2 wherein the inductance ferrite beads are evenly distributed along the length of the wire.

4. A lossy transmission line as claimed in claim 1 wherein the spacing of the resistive beads increases exponentially to a maximum which is determined by the available space per unit length.

5. A lossy transmission line as claimed in claim 4 wherein inductance ferrite beads are also threaded on said wire and are evenly distributed along its length and all beads are separated by non conductive spacers.

6. A lossy transmission line comprising a stainless steel wire threaded with ferrite inductance beads evenly distributed along its length and ferrite resistive beads which increase exponentially in distribution along its length from the beginning of the wire up to a maximum distribution per unit length which is determined by the available space per unit length.

7. A lossy transmission line as claimed in claim 6 wherein the ferrite beads are separated by non conductive spacers.

8. A lossy transmission line as claimed in claim 7 wherein the threaded wire, the beads and the spacers are enclosed in an hermetically sealed tube.

* * * * *